United States Patent [19]

Capdepuy et al.

[11] Patent Number: 4,821,045

[45] Date of Patent: Apr. 11, 1989

[54] ANTENNA POINTING DEVICE CAPABLE OF SCANNING IN TWO ORTHOGONAL DIRECTIONS

[75] Inventors: Marc Capdepuy, Fontenilles; Régis Lenormand, Toulouse; Daniel Renaud, Frouzins, all of France

[73] Assignee: Alcatel Espace, Courbevoie Cedex, France

[21] Appl. No.: 204,949

[22] Filed: Jun. 7, 1988

Related U.S. Application Data

[62] Division of Ser. No. 806, Jan. 6, 1987, abandoned.

[30] Foreign Application Priority Data

Jan. 9, 1986 [FR] France ..... 86 00223

[51] Int. Cl.[4] ..... H01Q 19/18; H01Q 3/12

[52] U.S. Cl. ..... 343/781 R; 343/781 P; 343/761

[58] Field of Search ..... 343/781 P, 781 CA, 781 R, 343/837, 761

[56] References Cited

U.S. PATENT DOCUMENTS 4,516,128 5/1985 Watanabe et al. ..... 343/781 P 4,525,719 6/1985 Sato et al. ..... 343/781 CA

FOREIGN PATENT DOCUMENTS 1338471 7/1962 France ..... 343/781 P

*Primary Examiner*—William L. Sikes
*Assistant Examiner*—Doris J. Johnson
*Attorney, Agent, or Firm*—Sughrue, Mion, Zinn, Macpeak, and Seas

[57] ABSTRACT

An antenna pointing device capable of scanning in two orthogonal directions comprises a fixed source (20) emitting a radio beam (21) and associated with a main offset reflector (10) and a secondary offset reflector (11), together with a set of at least three mirrors (14, 15, and 17) including a first mirror (14) aligned with the secondary reflector (11), and in which the second and third mirrors (15 and 17) are fixed to respective rotary drive mechanisms (16 and 18) for rotating them about two axes (Δ, Δ') extending in orthogonal directions. The main and the secondary reflectors (10, 11) and the first and the second mirrors (14, 15) are mechanically fixed to one another in order to constitute a moving assembly. The second mechanism (18) drives both the third mirror (17) and said moving assembly (10, 11, 14, and 15).

7 Claims, 3 Drawing Sheets

ANTENNA POINTING DEVICE CAPABLE OF SCANNING IN TWO ORTHOGONAL DIRECTIONS

This is a division of application Ser. No. 000,806, filed Jan. 6, 1987, now abandoned.

The present invention relates to an antenna pointing device capable of scanning in two orthogonal directions.

BACKGROUND OF THE INVENTION

This type of scan can be provided by using a universal joint type of drive capable of tilting about two axes X and Y, and serving to point an entire antenna assembly. However, the source, sometimes together with radio equipment other than the source, must also be moved with the antenna, thereby increasing the moving mass and giving rise to problems of electrical connection between the antenna and its support.

Such a system capable of tilting about two orthogonal axes may also be used for pointing solely an offset reflector, with the source remaining fixed. However, moving the reflector relative to the source gives rise to a loss of focus which may have an effect, in turn, on the phase relationship of the radiation during large swings and if operating at high frequencies, e.g. higher than 20 GHz.

The present invention seeks to mitigate the above drawbacks by providing a device capable of pointing a beam to perform an X-Y scan about two orthogonal axes.

SUMMARY OF THE INVENTION

The present invention provides an antenna pointing device capable of scanning in two orthogonal directions, the device comprising a fixed source emitting a radio beam and associated with a main offset reflector and a secondary offset reflector, the device including the improvement of a set of at least three mirrors, including a first mirror which is aligned with the secondary reflector, and a second and a third mirror which are fixed to two respective rotary drive mechanisms for providing rotary drive about two axes extending in orthogonal directions, the direction of the mean axis of the parallel beam between said second and third mirrors being the axis of the beam radiated from the main receptor, with the axis of rotation of the first mechanism being colinear with the mean axis of the parallel beam between the first and second mirrors, with the axis of rotation of the second mechanism being colinear with the mean axis of the parallel beam from the source which is applied to the third mirror, and with the main and the secondary reflectors and the first and the second mirrors being mechanically interconnected to constitute a moving assembly with the second mechanism driving both the third mirror and said moving assembly.

This invention has the advantage of using two offset reflectors, thereby avoiding shadow areas in the radiation emitted by the main reflector, and thus enabling the overall device to be particularly compact.

The invention also allows the beam radiated by the antenna to be pointed without unfocusing the source and without displacing the reflector in such a way as to produce aberrations in the radiation.

BRIEF DESCRIPTION OF THE DRAWINGS

An embodiment of the invention is described by way of example with reference to the accompanying drawings, in which.

MORE DETAILED DESCRIPTION

Figure 1:
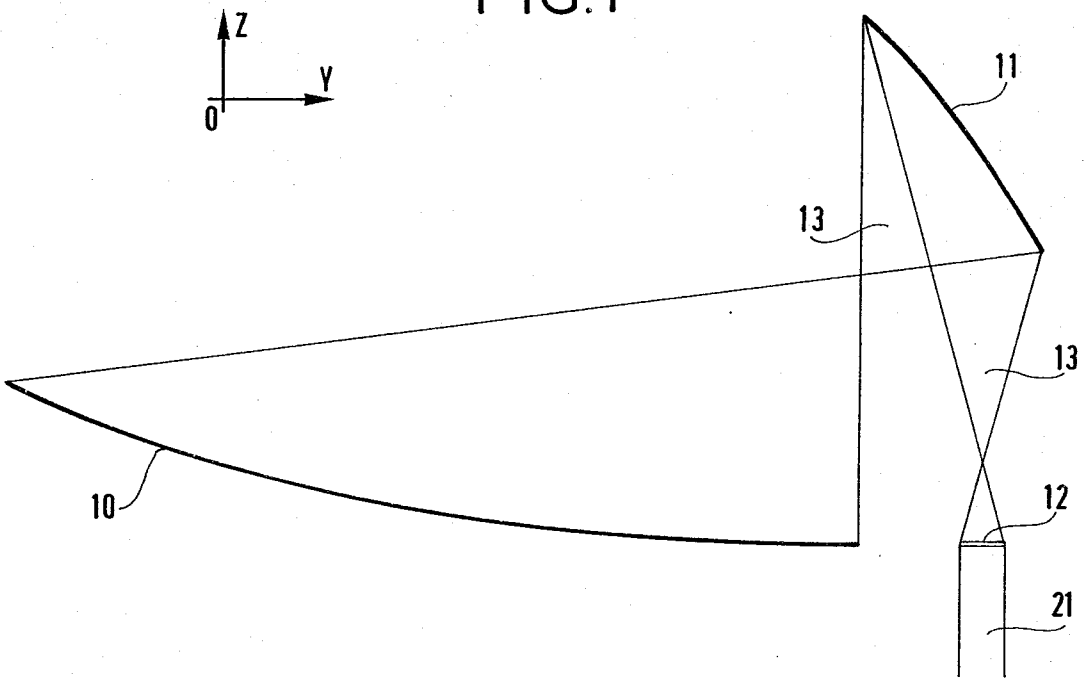
FIG. 1 is a diagram showing a portion of an antenna pointing device in accordance with the invention.
Figure 2:
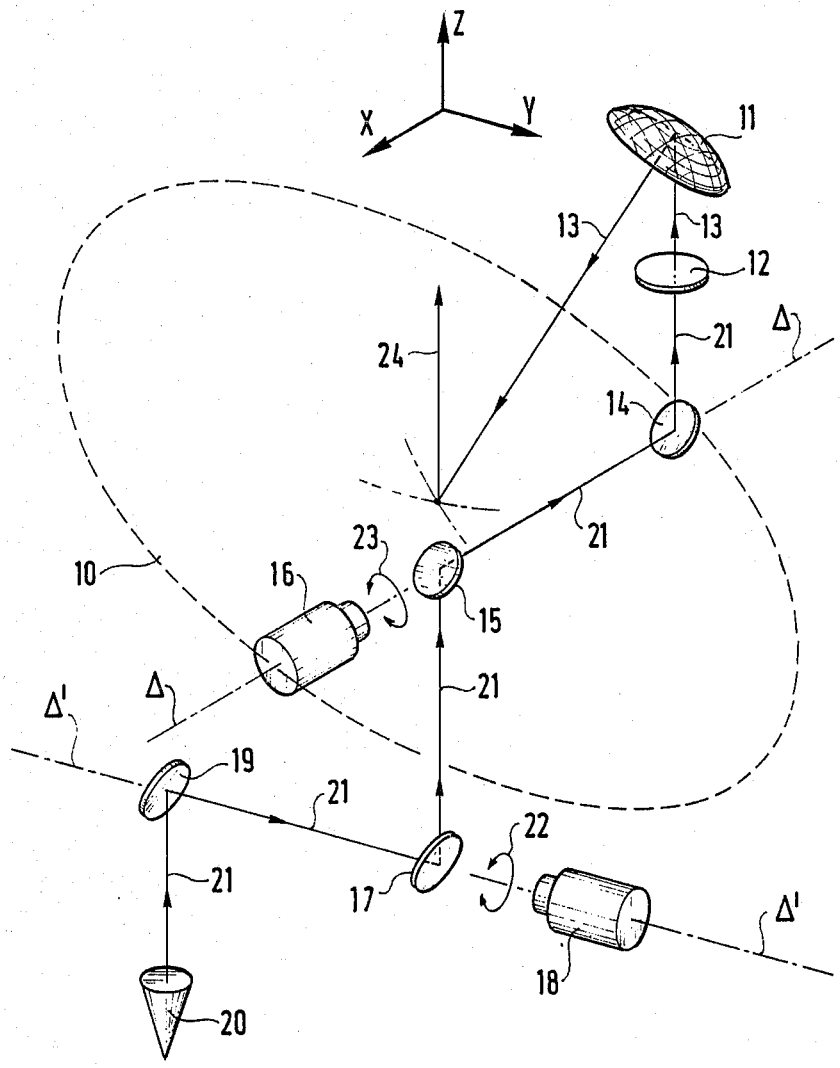
FIG. 2 is a diagrammatic perspective view of an antenna pointing device in accordance with the invention.

An antenna pointing device in accordance with the invention comprises:

an axis Δ extending parallel to a direction OX and supporting top portion of the antenna;

an axis Δ′ extending parallel to a direction OY and supporting a central portion of the antenna, together with the axis Δ; and a fixed portion which is fixed relative to the source.

The device in accordance with the invention thus comprises a first assembly movable about the axis Δ and comprising:

an offset main reflector 10, i.e. a reflector which is offset relative to the apex of the parabola of which it constitutes a portion, and whose center lies on a straight line extending in a direction OZ perpendicular to both axes Δ and Δ′;

a secondary reflector 11 (also known as a subreflector) likewise constituted by an offset reflector;

an optional lens 12 for focusing the radio beam 21;

a first mirror 14 for pointing the beam 21; and a second mirror 15 making it possible to have two orthogonal axes.

This assembly is mounted on the axis of a mechanism 16 which is capable of developing a sufficiently large driving torque to drive said load, and whose pointing accuracy is high, in relation to the width of the beam.

The device also includes a second assembly which comprises:

a third mirror 17 centered on the axis Δ′; and a moving portion of a mechanism 18 which is fixed to said mirror 17.

The mechanism 18 providing drive about the axis Δ′ may be identical to the drive mechanism 16 about the axis Δ. They operate through similar angles and are subjected to similar stresses.

Finally, the device comprises a fixed portion which is fixed to the antenna support and which has components that may be mechanically connected to each other or may be individually connected to the support. This fixed portion comprises:

the support for the mechanism 18 providing drive about the axis Δ′;

a fourth mirror 19; and a source assembly 20 for delivering a radio beam 21.

This device which has a fixed source 20 has the major advantage of avoiding the use of rotary connections or cable winders, and of having no need to move radio equipment. In addition, it reduces the mass that needs pointing and thus limits disturbing forces.

The source 20 emits a radio beam 21 which is successively reflected on four mirrors 19, 17, 15, and then 14 prior to being focused by converging lens 12 and then reaching the subreflector 11 followed by the main reflector 10.

The mechanism 18 rotates the mirror 17 about the axis Δ' (see arrow 22); this axis is parallel to the direction OY corresponding to the means axis of the beam 21 between the mirror 19 and the mirror 17. The mirror 17 reflects the beam 21 at 90° towards the mirror 15.

The mean axis of the beam 21 between the mirrors 17 and 15 coincides with the axis OZ and corresponds to the radiation axis of the antenna, i.e. to the axis of the beam 24 reflected by the main reflector 10.

The mirror 15 is fixed to the assembly constituted by the mirror 14, the lens 12, the secondary reflector 11, and the main reflector 10.

This assembly 15, 14, 12, 11, 10 is mechanically rotated about the axis Δ (see arrow 23) by means of the mechanism 16, with the axis Δ constituting the mean axis of the beam 21 between the mirrors 15 and 14.

The mirror 15 thus receives the beam 21 from the mirror 17 and changes its plane by deflecting it towards the mirror 14 which then positions the beam 21 so as to be centrally located relative to the lens 12.

The two mechanisms 18 and 16 are thus positioned in such a manner that their axes of rotation Δ' and Δ coincide with the mean beam axes respectively reaching the mirror 17 or leaving the mirror 15, which axes are mutually orthogonal.

The two mirrors 17 and 15 are rotated by the mechanism 18 and 16 about the axes Δ' and Δ. However, each of these mechanisms drives both the mirror located on its own axis and the top portion of the antenna about the axis OZ.

The drive torque provided by these mechanisms is greater than the torque necessary for driving the antenna.

The mechanical connection structure between the various assemblies which must be capable of withstanding environmental stresses lies within the compentence of the person skilled in the art and has therefore not been shown in the figures.

The two drive mechanisms 18 and 16 may be identical and may include respective step-down systems thereby presenting the advantages of reducing the pointing step size and of increasing the drive torque.

Each drive mechanism 18 or 16 includes an angle encoding system, for example an optical encoder or a resolver which is associated with a motor assembly.

Naturally, the present invention is described above solely by way of example and each of its component parts could be replaced by equivalent items without going beyond the scope of the invention.

Thus, the various mirros 19, 17, 15, 14 may be plane or shaped, depending on the application. At high frequencies, the beam 21 coming the the source may be parallel and the mirrors 19, 17, 15 and 14 may then be plane.

Figure 3:
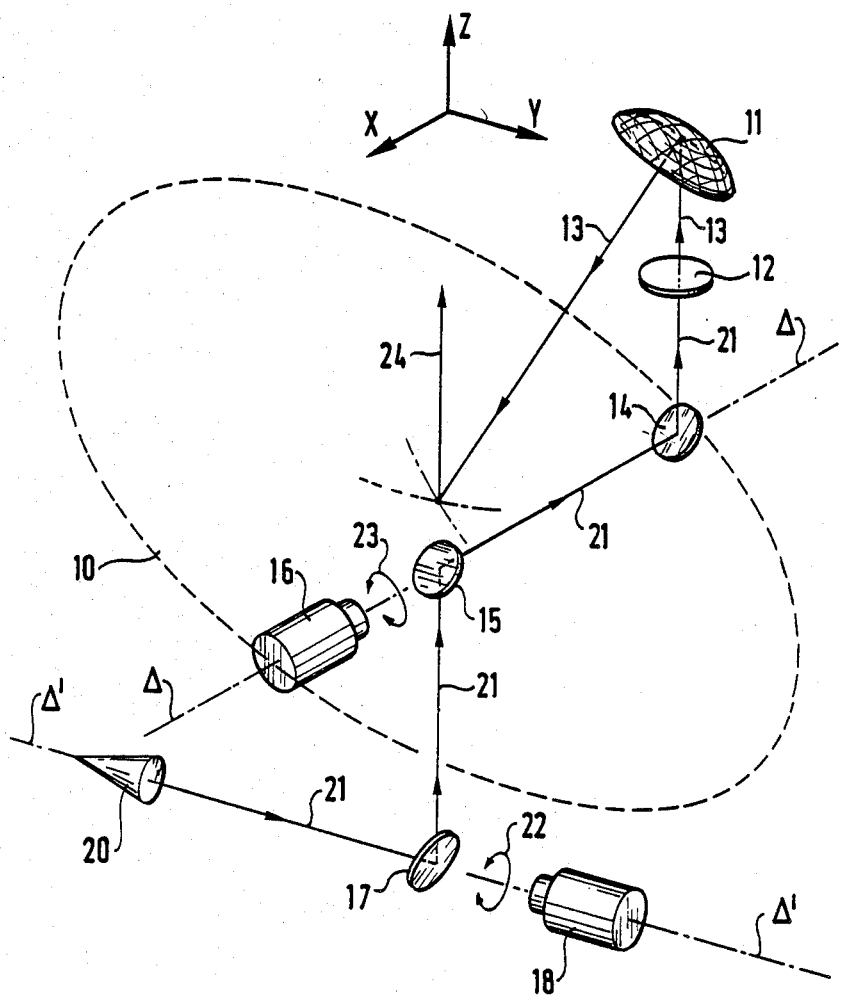
FIG. 3 is a diagrammatic perspective view of an antenna pointing device forming a further embodiment of the invention.

Thus, the mirror 19 is optional since the source 20 could be disposed to provide a beam which is pointed directly on the mirror 17 as per FIG. 3. However, the mirror 19 has the advantage of allowing the source 20 to be placed more conveniently. In a manner well known to the person skilled in the art, the mirror 19 could be replaced by a set of several mirrors.

Thus, the lens 12 could be eliminated if the beam from the mirror 14 is properly focused to intercept the subreflector 11.

The antenna pointing device is shown in the figures for a system operating as a transmitter, however the same geometrical configuration is easily applicable to a system operating as a receiver.

We claim:

1. In an antenna pointing device operatively associated with a main offset reflector and a secondary offset reflector and being capable of scanning in two orthogonal directions, said device comprising a fixed source emitting a radio beam, the improvement comprising a set of at least three mirrors and first and second rotary drive mechanisms, said at least three mirrors including a first mirror which is aligned with said secondary reflector and a second and a third mirror which are fixed respectively to said first and second respective rotary drive mechanisms for providing rotary drive about two axes Δ and Δ', respectively extending in orthogonal directions, the direction of the mean axis of the parallel beam between said second and third mirrors being parallel to the axis Z of the beam radiated from the main reflector, said axes of rotation Δ and Δ' being perpendicular to said axis Z of the beam radiated from the main reflector near the zenith of the scanning zone of the antenna, the axis Δ' of rotation of the second mechanism being colinear with the mean axis of the parallel beam 21 from the source which is applied to the third mirror, and the secondary reflector and the first and second mirrors being mechanically interconnected and constituting a moving assembly, said second mechanism operatively driving the third mirror and said first mechanism operatively driving said moving assembly, whereby for aiming trajectories situated in a solid angle near the zenith, the rotations around the axes Δ and Δ' remain small with the antenna well fitted for tracking near that zenith.

2. A device according to claim 1, wherein said at least three mirrors further comprises a fourth mirror, said fourth mirror being disposed between the source and the third mirror and forming a further third assembly such that said second mechanism operatively drives both said third and fourth mirrors.

3. A device according to claim 1, wherein a lens is disposed between the first mirror and the secondary reflector.

4. A device according to claim 1, wherein the mirrors are plane mirrors.

5. A device according to claim 1, wherein the mirrors are shaped mirrors.

6. A device according to claim 1, wherein each of the drive mechanisms includes a stepdown system.

7. A device according to claim 1, wherein each drive mechanism includes a angle encoding system.

* * * * *